US010863780B2

(12) United States Patent
Athauda et al.

(10) Patent No.: US 10,863,780 B2
(45) Date of Patent: Dec. 15, 2020

(54) COMPONENT FOR GARMENT OR TEXTILE PRODUCT

(71) Applicant: MAS INNOVATION (PRIVATE) LIMITED, Colombo (LK)

(72) Inventors: Tharindu Athauda, Colombo (LK); Nadeeshani Gunathilake, Colombo (LK); Mahela Kandegedara, Colombo (LK); Sachithra Prathapasinghe, Colombo (LK)

(73) Assignee: MAS INNOVATION (PRIVATE) LIMITED, Colombo (LK)

( * ) Notice: Subject to any disclaimer, the term of this patent is extended or adjusted under 35 U.S.C. 154(b) by 0 days.

(21) Appl. No.: 16/349,231

(22) PCT Filed: Nov. 10, 2017

(86) PCT No.: PCT/SG2017/050564

§ 371 (c)(1),
(2) Date: May 10, 2019

(87) PCT Pub. No.: WO2018/088964

PCT Pub. Date: May 17, 2018

(65) Prior Publication Data

US 2019/0289927 A1 Sep. 26, 2019

Related U.S. Application Data

(60) Provisional application No. 62/420,348, filed on Nov. 10, 2016.

(51) Int. Cl.
*A41D 1/00* (2018.01)
*H01R 4/06* (2006.01)
(Continued)

(52) U.S. Cl.
CPC ..... *A41D 1/005* (2013.01); *H01R 4/06* (2013.01); *H01R 4/2404* (2013.01);
(Continued)

(58) Field of Classification Search
CPC ..... A41D 1/002; A41D 1/005; H01R 4/06; H01R 4/2404; H01R 13/6205; H01R 43/0104
(Continued)

(56) References Cited

U.S. PATENT DOCUMENTS 5,312,269 A 5/1994 Hwang
6,854,988 B2 * 2/2005 Marmaropoulos .... A41D 1/005 2/69
(Continued)

FOREIGN PATENT DOCUMENTS

EP 2679107 A1 1/2014
JP 2009-105027 A 5/2009
WO 2016/099669 A1 6/2016

OTHER PUBLICATIONS

International Search Report corresponding to PCT/SG2017/050564 dated Mar. 23, 2018; 4 pages.
(Continued)

*Primary Examiner* — Gary F Paumen
(74) *Attorney, Agent, or Firm* — Mintz Levin Cohn Ferris Glovsky and Popeo, P.C.

(57) ABSTRACT

A component for a garment or textile product is disclosed. The component comprises a fabric substrate having a first surface and a second surface opposing the first surface; a contact pad formed from an electrically conductive material, the contact pad being configured to engage with a connector and arranged on the first surface of the fabric substrate; a conductive layer electrically coupled to the contact pad; and
(Continued)

an electrically conductive line mechanically coupled to, and in electrically conductive contact with, the conductive layer.

17 Claims, 9 Drawing Sheets

(51) Int. Cl.
*H01R 4/2404* (2018.01)
*H01R 13/62* (2006.01)
*H01R 43/01* (2006.01)
*H01R 43/04* (2006.01)

(52) U.S. Cl.
CPC ..... *H01R 13/6205* (2013.01); *H01R 43/01* (2013.01); *H01R 43/04* (2013.01)

(58) Field of Classification Search
USPC ..... 439/37
See application file for complete search history.

(56) References Cited

U.S. PATENT DOCUMENTS

2011/0306218 A1* 12/2011 Chen ..... H01R 24/38 439/37
2013/0338472 A1 12/2013 Macia Barber et al.
2016/0073701 A1 3/2016 Maloney

OTHER PUBLICATIONS

Written Opinion of the International Searching Authority corresponding to PCT/SG2017/050564 completed Mar. 23, 2018; 8 pages.
International Preliminary Report on Patentability (Chapter I) corresponding to PCT/SG2017/050564 dated May 14, 2019; 10 pages.

* cited by examiner

COMPONENT FOR GARMENT OR TEXTILE PRODUCT

FIELD OF INVENTION

Embodiments disclosed herein relate generally to wearable technology and more specifically to components for garments and textile products that allow electrical connection to electrically conductive lines such as conductive yarn or wire within the garment or textile product.

BACKGROUND

In wearable technology applications, electrically conductive lines such as yarns are typically embedded within garments and under fabric substrates which form the outer surfaces of the garments. These conductive lines may be connected to electronic devices embedded within the garment. In order to supply electrical power to such devices and to establish an electrical connection with such devices it is necessary to provide an electrical contact on the surface of the fabric substrate.

In order to provide electrical heating within a garment, electrical heating elements may be embedded within the garment. The heating elements require much larger currents than applications such as sensing. In order to supply such currents to the heating elements the resistance of any connecting elements must be minimised, otherwise the currents may cause resistive heating in the connecting elements.

The construction of such electrical contact must be robust so that it is not damaged during use of the garment. The use of the garment may involve exposure to stresses and strains, and exposure to water and sweat. Further, garments and therefore the electrical connections contained within them must be robust enough to not be damaged during cleaning or laundering which may involve exposure to water, detergents and solvents used in dry cleaning.

Further, it is advantageous if both the construction of the electrical connection and the conductive lines are thin and therefore do not interfere with the fit, user physical and psychological comfort or performance of the garment.

SUMMARY OF INVENTION

According to a first aspect of the present invention, there is provided a component for a garment or textile product. The component comprises a fabric substrate having a first surface and a second surface opposing the first surface; a contact pad formed from an electrically conductive material, the contact pad being configured to engage with a connector and arranged on the first surface of the fabric substrate; a conductive layer electrically coupled to the contact pad; and an electrically conductive line mechanically coupled to, and in electrically conductive contact with, the conductive layer.

The fabric substrate forms part of the garment or textile product. The garment or textile product may, for example have an electronic device such as a sensor or a heating element embedded within. This device may be connected to the conductive line. Thus the contact pad allows an external electrical connection to be made with the electronic device. Embodiments of the present invention provide a durable connection between the contact pad and the conductive line. It is important that the electrical connection between the contact pad and the conductive line is durable as the garment or textile product may be subjected to stresses and strains caused by washing and/or cleaning or the garment and the garment may also be exposed to water and sweat during use.

The incorporation of the conductive layer to which the conductive line is attached facilitate this durable connection as the conductive layer provides a larger contact area therefore a more durable connection than a connection between the conductive yarn and the contact pad alone.

In some embodiments, the conductive line may be a conductive wire connected to a heating device. The conductive layer may be formed as a metal washer. Such embodiments provide a large connection area which in addition to the durable connection described above also provide a low resistance connection. This is particularly advantageous in heating application where large currents are required. The metal washer may have a thickness of less than 0.5 mm.

In some embodiments, the conductive layer is coupled to the second surface of the fabric substrate. The conductive layer may have a thickness of less than 0.2 millimetres. An electrical connection between conductive layer and the contact pad may be established by a coupling member. The electrically conductive line may comprise a conductive yarn having a thickness of less than 0.3 millimetres.

In some embodiments, the thickness dimensions mentioned above are optional.

In an embodiment, a Thermoplastic polyurethane (TPU) layer is provided between the between the fabric substrate and the conductive fabric section.

TPU layers may be provided either side of the conductive layer to encapsulate and thereby protect the conductive layer.

The contact pad may be configured to engage with the connector magnetically and/or mechanically.

Multiple conductive yarns may be connected to the conductive layer.

The coupling member may be formed from an elongate member extending from the contact pad. The inclusion of the conductive layer in the component allows a robust connection even when a relatively thin conductive yarn is used. Thus in some embodiments, a width of the elongate member is greater than a thickness of the conductive yarn. The contact pad may have one or more elongate legs which are crimped to couple the conductive yarn to the conductive layer. The contact pad and the elongate member may be formed from a rivet.

The conductive yarn may be coupled to the conductive layer by stitching and/or a conductive adhesive.

In an embodiment, the conductive layer is formed from a conductive fabric.

In an embodiment, the conductive layer comprises a first conductive layer section and a second conductive layer section, the first conductive layer section being electrically separated from the second conductive layer section, wherein a first conductive yarn is electrically coupled to the first conductive layer section and a second conductive yarn is coupled to the second conductive layer section.

In an embodiment, the component for a garment or textile product further comprises an encapsulating layer over the conductive yarn and the conductive layer. The encapsulating layer may comprise a waterproofing layer.

In some embodiments, the conductive yarn has a thickness of less than 0.15 millimetres.

According to a second aspect of the present invention there is provided a method of manufacturing a component for a garment or textile product. The method comprises: providing a fabric substrate having a first surface and a second surface opposing the first surface; providing a conductive layer coupled to the first surface of the fabric substrate, the conductive layer having a thickness of less than 0.5 millimetres; piercing an elongate member coupled to a contact pad through the fabric substrate and the conductive layer such that the contact pad is arranged on the first surface of the fabric substrate, the contact pad being configured to engage with a connector and; attaching a conductive line to the conductive layer.

In some embodiments the conductive line passes though the fabric substrate. The conductive line may be a wire. The conductive layer may be formed form a metal washer. The method may further comprise soldering the conductive line to the conductive layer.

According to a third aspect of the present invention, there is provided a method of manufacturing a component for a garment or textile product. The method comprises providing a fabric substrate having a first surface and a second surface opposing the first surface; providing a conductive layer coupled to the second surface of the fabric substrate, the conductive layer having a thickness of less than 0.2 millimetres; arranging a contact pad on the first surface of the fabric substrate, the contact pad being configured to engage with a connector and formed from an electrically conductive material; establishing an electrical contact between the conductive layer and the contact pad; and attaching a conductive yarn in conductive contact with the conductive layer, the conductive yarn having a thickness of less than 0.3 millimetres.

In some embodiments, the thickness dimensions mentioned above are optional.

In an embodiment attaching a conductive yarn in conductive contact with the conductive layer comprises attaching the conductive yarn stitching and/or a conductive adhesive.

In an embodiment, the conductive layer comprises a conductive fabric.

In an embodiment, the method further comprises laying an encapsulating layer over the conductive yarn and the conductive layer. The encapsulating layer may comprise a waterproof layer.

According to a fourth aspect of the present invention, there is provided a method of manufacturing a component for a garment or textile product. The method comprises: providing a fabric substrate having a first surface and a second surface opposing the first surface; providing a conductive layer coupled to the second surface of the fabric substrate, the conductive layer having a thickness of less than 0.2 millimetres; piercing an elongate member coupled to a contact pad through the fabric substrate and the conductive layer such that the contact pad is arranged on the first surface of the fabric substrate and the elongate member establishes an electrically conductive connection between the contact pad and the conductive layer, the configured to engage with a connector and; and attaching a conductive yarn to the layer, the conductive yarn having a thickness of less than 0.3 millimetres.

In some embodiments, the thickness dimensions mentioned above are optional.

In an embodiment, the method further comprises crimping an end of the elongate member.

In an embodiment attaching a conductive yarn in conductive contact with the conductive layer comprises attaching the conductive yarn stitching and/or a conductive adhesive.

In an embodiment, the conductive layer comprises a conductive fabric.

In an embodiment, the method further comprises laying an encapsulating layer over the conductive yarn and the conductive layer. The encapsulating layer may comprise a waterproof layer.

BRIEF DESCRIPTION OF THE DRAWINGS

Some embodiments of the present invention are described more fully hereinafter with reference to the accompanying drawings. In the drawings, dimensions may be exaggerated for clarity of illustration. Like reference numerals refer to like elements throughout.

DETAILED DESCRIPTION

Figure 1:
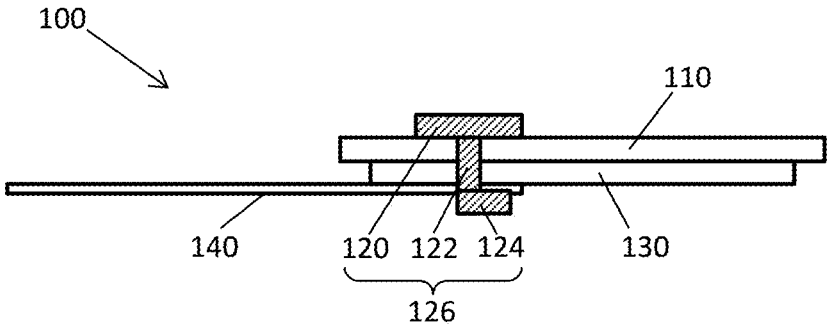
FIG. 1 shows a cross sectional view of a component for a garment or textile product according to an embodiment of the present invention.

In the following detailed description, only certain embodiments of the present invention have been shown and described, simply by way of illustration. As those skilled in the art would realise, the described embodiments may preferably be modified in various different ways, all without departing from the spirit or scope of the present invention. Accordingly, the drawings and description are to be regarded as illustrative in nature and not restrictive. In addition, when an element is referred to as being "on" another element, it can be directly on the other element or be indirectly on the other element with one or more intervening elements interposed therebetween. Also, when an element is referred to as being "connected to" another element, it can be directly connected to the other element or be indirectly connected to the other element with one or more intervening elements interposed therebetween. Hereinafter, like reference numerals refer to like elements.

FIG. 1 shows cross sectional view of a component for a garment or textile product according to an embodiment of the present invention. The component 100 comprises a fabric substrate 110. The fabric substrate 110 may form part of a garment or other textile product. The fabric substrate 110 may be of any suitable material. For example, when the fabric substrate is in the form of a garment, the textile or garment may be made of one or more of any suitable natural or synthetic material such as nylon, polyester, cotton, rayon, leather, flax, wool, ramie, silk, fur, polyesters, bamboo, jute, hemp, elastane, flannel or blends thereof. These materials may be in the form of woven, knit, non-woven or fibre like structures.

A contact pad 120 is located on a surface of the fabric substrate 110. In the arrangement shown in FIG. 1, the contact pad 120 is arranged on the upper surface of the fabric substrate 110. The contact pad 120 is formed from an electrically conductive material such as a metal. A conductive layer 130 is arranged against a surface of the fabric substrate 110. The section of conductive fabric 130 is arranged against the opposite surface of the fabric substrate 110 to the contact pad 120. In the arrangement shown in FIG. 1, the contact pad 120 is on the top surface of the fabric substrate 110 and the conductive layer 130 is arranged against the bottom surface of the fabric substrate 110.

The conductive layer 130 may be formed from conductive fabric, that is a fabric or textile that can conduct electricity. The conductive layer 130 may be formed from a textile having metal or conductive fibers woven into, or embroidered onto the construction of the fabric. These conductive fibers may be conductive yarns as described in more detail below. The conductive fibers may comprise a non-conductive or less conductive substrate, which is coated or embedded with electrically conductive elements, such as carbon, nickel, copper, gold, silver, stainless steel, aluminium or titanium. The conductive layer may also be formed from any other conductive surface such as a metal sheet, and a flexible plastic surface printed with a conductive layer. The conductive layer may be formed from a conductive rubber or conductive TPU. The conductive layer may be formed from conductive Print, conductive adhesive or conductive TPU, conductive soldering or glue on a substrate, metal yarn embroidery, a conductive non-woven substrate, and/or a conductive gel on a substrate.

The conductive fabric used in embodiments described herein may have a thickness in the range 0.15 to 0.2 millimetres. In some embodiments the conductive fabric has a thickness of less than 0.2 millimetres.

A conductive yarn 140 is attached to the conductive layer 130. As discussed in more detail below, the conductive yarn 140 has an uninsulated terminal section. This uninsulated terminal section is in contact with the conductive layer 130. Thus, the conductive yarn 140 is in electrically conductive contact with the conductive layer 130.

The conductive yarn 140 is also mechanically coupled to the conductive layer 130. In this embodiment, the contact pad 120 has an elongate coupling portion 122 which extends through the fabric substrate 110 and the conductive fabric 130. The end of the coupling portion 122 has a crimped part 124 which holds the conductive yarn 140 against the conductive layer 130. The crimped part 124 and/or the coupling portion 122 of the contact pad 120 are in contact with the conductive layer 130. The contact pad 120 may be formed as a single element such as a rivet 126 made from an electrically conductive material, and comprising the pad portion, the coupling portion 122 and crimped part 124. Thus, an electrical connection exists between the conductive yarn 140 and the contact pad 120.

In the embodiment described above, the conductive yarn 140 is held in place by the crimped part 124 of the contact pad 120. Alternative embodiments are envisaged in which the conductive yarn is attached to the conductive layer 130, and the conductive fabric provides an electrical connection between the coupling portion 122 of the contact pad 120 and the conductive yarn 140.

In embodiments, further layers are added to the component described above. These layers may be intermediate boding layers between the conductive fabric and the fabric substrate. Such layers may also provide the garment or textile product with properties such as insulation, or waterproofing.

Additionally, or alternatively, further layers may be placed over the fabric substrate and/or the conductive fabric to encapsulate the conductive layer and the conductive yarn. Such encapsulation layers may provide protection and electrical insulation of the conductive layer and the conductive yarn. As discussed in more detail below, the conductive yarn may comprise a protective insulating material. In embodiments, the encapsulating layer may cover the conductive yarn and thus provide such protection and insulation.

Any suitable conductive yarn may be used in embodiments of the present invention, provided that there is provided an uninsulated terminal section. In certain embodiments, the entire conductive yarn may be uninsulated, while in other embodiments, the majority of the conductive yarn may be protected by an insulating material. It will be appreciated that the terminal section of the conductive yarn may be provided with an insulating material that is removed from the terminal section of the conductive yarn to provide an uninsulated conductive yarn.

When used herein, the term "yarn" is intended to take its ordinary meaning in the art (long continuous length of interlocked fibres, suitable for use in one or more of the production of textiles, crocheting, knitting, weaving, embroidery and, more particularly sewing), though it is expanded herein to also cover the use of single filaments of a material, such as a metallic filament. Thus, the uninsulated conductive yarn may be a thin metal wire (e.g. a metal filament suitable for use in one or more of the production of textiles, crocheting, knitting, weaving, embroidery and, more particularly sewing), a metal yarn (i.e. interlocking metal fibers), a yarn or filament made from a conductive polymer, and a conductive composite yarn.

A number of different kinds of conductive composite yarns exist. A first type of conductive composite yarn comprises a normal non-conductive yarn's fibres as a core material that is impregnated with at least one conductive material, such as a metal or a non-metallic conductive material, which latter material may be provided in part in a polymer matrix. A second type of conductive composite yarn comprises a normal non-conductive yarn's fibres as a core material that is then wound together with one or more filaments/fibres of a metal and/or a non-metallic conductive material. A third type of conductive composite yarn comprises a non-metallic conductive material, such as carbon nanotubes or graphene along with a polymeric material, wherein the non-metallic conductive material may be distributed homogeneously throughout the polymeric material to provide a conductive yarn, or the non-metallic conductive material is aligned to form a yarn, with a polymer dispersed within the spaces created in said yarn (e.g. a continuous superaligned carbon nanotube yarn as a conductive framework with polyvinyl alcohol inserted into the intertube spaces of the framework, as described in Liu et al. ACS Nano, 2010, 4 (10), pp 5827-5834). The conductive yarn may comprise stainless or other metallic components such as silver, copper, aluminium, and bi-component metal alloys. The conductive yarn may comprise metal yarn combined with polyester/nylon/cotton/wool/silk etc. In some embodiments the conductive yarn comprises metal yarn wrapped around with elastin filament.

In embodiments, the conductive yarns has a thickness of less than 0.3 millimetres, in some embodiments the thickness of the conductive yarn is less than 0.15 millimetres.

Metals that may be included in aspects and embodiments of the invention include, but are not limited to, iron, copper, silver, gold, aluminium, brass, titanium, and platinum and alloys thereof. For example, a metal alloy that may be included herein is stainless steel.

It will be appreciated that when more than one conductive yarn is used in embodiments of the invention, they may be made of the same material or of different materials. For example, silver coated yarns, stainless steel coated yarns, copper wires, and silver wires may all be used in conjunction in certain embodiments of the invention.

The insulating material for the conductive yarn mentioned herein may be any suitable insulating material. For example, the insulating material may be one or more of a varnish, a latex, a silicone polymer, an epoxy resin, a polymeric fluorocarbon, a thermoplastic elastomer, and a polyurethane. Particular insulating materials that may be mentioned herein include a synthetic or natural rubber, a thermoplastic polyurethane or combinations thereof. Other materials that may be mentioned herein include a silicone polymer.

Figure 2:
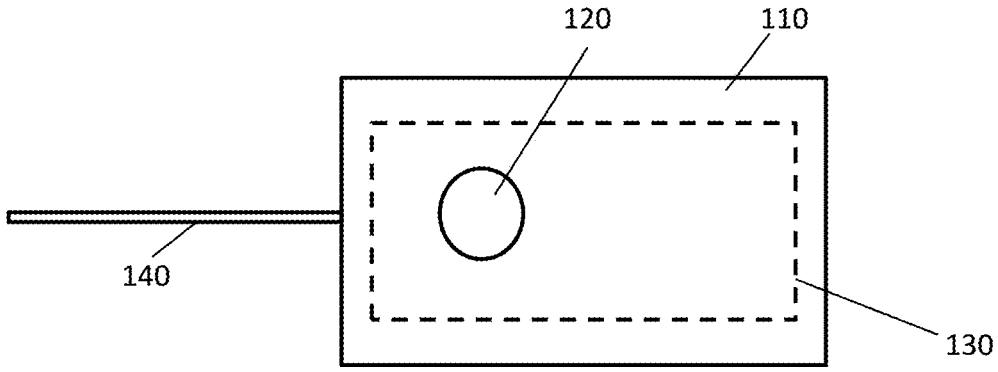
FIG. 2 shows a plan of view of a component for a garment or textile product according to an embodiment of the present invention.

FIG. 2 shows a plan of view of a component for a garment or textile product according to an embodiment of the present invention. As shown in FIG. 2, the contact pad 120 is located on the fabric substrate 120. The conductive yarn 140 extends from the component 100 under the fabric substrate 120. In this embodiment, the contact pad 120 is circular. The conductive layer 130 is under the fabric substrate.

As mentioned above, the purpose of the component 100 is to allow an electrical connection to be established with the conductive yarn 140 which is embedded in or under the fabric substrate 110. A connection to the conductive yarn 140 can be established by coupling a connecting wire to the contact pad 120

In some embodiments, the contact pad 120 is configured to engage with a connector attached to the connecting wire. This is described in more detail with reference to FIG. 3 and FIG. 4 below.

Figure 3:
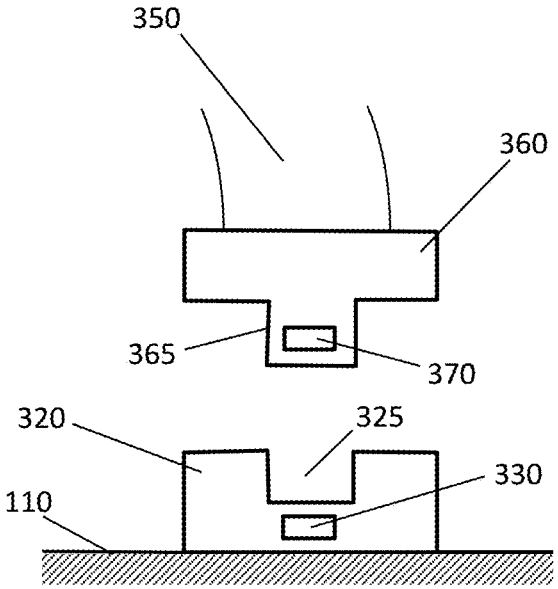
FIG. 3 shows a contact pad according to an embodiment of the present invention which is configured to magnetically engage with a connector.

FIG. 3 shows a contact pad according to an embodiment of the present invention which is configured to magnetically engage with a connector. As shown in FIG. 3, the contact pad 320 is arranged on the fabric substrate 110. The contact pad 320 has a recess 325 in the center and a magnet 330 is embedded in the contact pad 320 below the recess 325.

The connecting wire 350 is attached to a connector 360. The connector 360 has a protrusion 365 which is shaped to fit into the recess 325 of the contact pad 320. A magnet 370 is embedded in the protrusion 365. The magnet 330 embedded in the contact pad 320 and the magnet embedded in the connector 360 are arranged to attract each other. Thus the magnetic attraction between the magnets causes the contact pad 320 to engage with the connector 360.

Various modifications may be made to the arrangement shown in FIG. 3, for example, rather than embedded magnets in the connector 360 and the contact pad 320, one or both of the connector 360 and the contact pad 320 may be formed from a ferromagnetic material which is permanently magnetized such that the connector 360 and/or the contact pad 320 form one or both of the magnets. Further, one of the connector 360 and the contact pad 320 may contain or comprise a magnet and the other may be formed from a ferromagnetic material which is attracted to the magnet.

Further, while in the embodiment shown in FIG. 3, the contact pad 320 comprises a recess 325 and the connector 360 comprises a protrusion 365, it will be appreciated that the configurations of the connector and the contact pad may be reversed. Thus, the connector may comprise a recess which is configured to receive a protrusion on the contact pad. In a further possible embodiment, the connector and the contact pad have flat engagement surfaces wherein there is only magnetic engagement between the connector and the contact pad.

Figure 4:
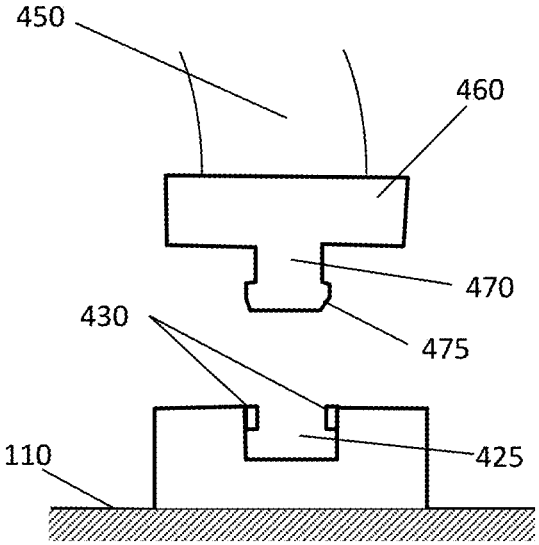
FIG. 4 shows a contact pad according to an embodiment of the present invention which is configured to mechanically engage with a connector.

FIG. 4 shows a contact pad according to an embodiment of the present invention which is configured to magnetically engage with a connector. In this embodiment, the contact pad 420 forms one half of a 'snap fastener'. As shown in FIG. 4, the contact pad 420 is arranged on the fabric substrate 110. The contact pad 420 has a recess 425 in the center and protrusions 430 at the top edge of the recess extend into the recess 425. The protrusions 430 are resiliently deformable.

The connecting wire 450 is attached to a connector 460. The connector 460 has a protrusion 470 which is shaped to fit into the recess 425 of the contact pad 420. The protrusion 470 has a lip 475 which is arranged to engage with the protrusions 430 around the edge of the recess 425 in the contact pad 420. Thus the connector 460 and the contact pad 420 are configured to mechanically engage with each other.

Various modifications may be made to the arrangement shown in FIG. 4, for example, it will be appreciated that the configurations of the connector and the contact pad may be reversed. Thus, the connector may comprise a recess which is configured to receive a protrusion on the contact pad.

The interconnection illustrated in FIGS. 3 and 4 can be easily disconnected and reconnected. This allows, for example, a power module associated with electronics embedded in a garment to be easily disconnected for charging of the power module and washing of the garment.

Figure 5A:
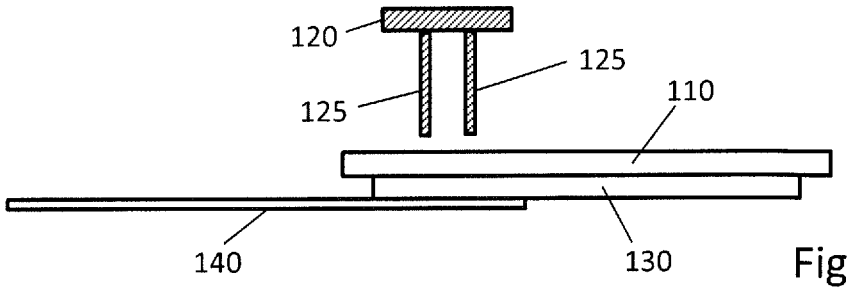
FIGS. 5A to 5C illustrate a method of manufacturing a component of a garment or textile product according to an embodiment of the present invention.
Figure 5B:
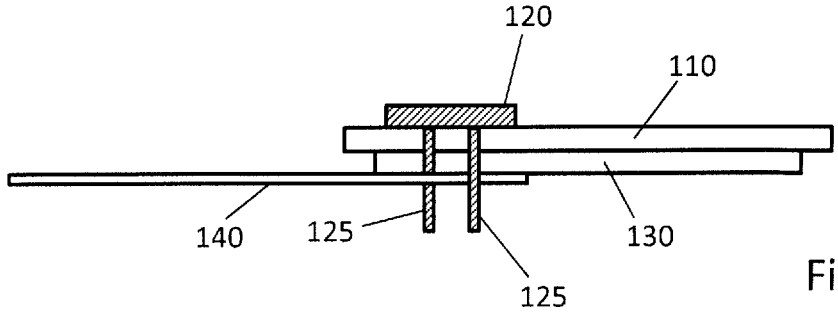
Figure 5C:
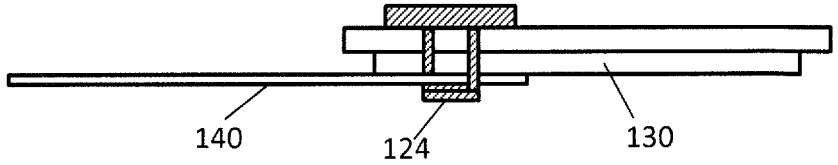

FIGS. 5A to 5C illustrate a method of manufacturing a component of a garment or textile product according to an embodiment of the present invention.

As shown in FIG. 5A, in this embodiment, the contact pad 120 comprises two elongate legs 125 which extend downwards. The conductive layer 130 is arranged below the fabric substrate 110. In some embodiments, the fabric substrate 110 and the conductive layer 130 may be bonded together with an intermediate layer. Examples of such an intermediate layer include thermoplastic polyurethane (TPU), for example Bemis 3415 manufactured by Bemis Associates Inc. In addition to providing bonding between the fabric substrate 110 and the conductive layer 130, the intermediate layer may also provide other properties such as insulation and waterproofing.

As shown in FIG. 5A, the conductive yarn 140 is placed against the conductive fabric 130.

As shown in FIG. 5B, the contact pad 120 is pressed against the fabric substrate 110 with a force such that the elongate legs 125 pierce the fabric substrate 110 and the conductive fabric 130. As shown in FIG. 5B, the conductive yarn 140 runs between the elongate legs 125.

Then, as shown in FIG. 5C, the elongate legs 125 are crimped or deformed to form a crimped part 124. The crimped part 124 holds the conductive yarn 140 against the conductive fabric 130.

In one embodiment, the fabric substrate 110 and the conductive layer 130 are thermally bonded together and the piercing and crimping steps described above take place before the thermal bonding adhesive has hardened. An advantage of such embodiments is that the bonding layer will harden after piercing and crimping steps and thus water tight seal may be formed.

In some embodiments, a hard and non-stretchable thermal bonding material may be incorporated between the fabric substrate 110 and the conductive layer 130. Such embodiments have the advantage that the component may be more durable and therefore the electrical connections between the conductive yarn and the contact pad can be ensured.

In the embodiment described above with reference to FIGS. 5A to 5C, the conductive yarn is mechanically and electrically coupled to the conductive fabric by the crimped elongate legs of the contact pad. Embodiments are envisaged in which the conductive yarn is attached to the conductive layer by other methods. For example, the conductive yarn may be attached to the conductive layer by stitching, either by stitching the conductive yarn itself through the conductive layer or by stitching over a part of the conductive yarn where it overlaps with the conductive layer. Alternatively, the conductive yarn may be attached to the conductive layer with a conductive adhesive. The conductive yarn may be attached to the conductive layer by hot melt glue or soldering or gluing with a glue that has electrical conductivity. The conductive layer may be formed from a conductive TPU, Conductive printed surfaces such as flexible electronics and the material forming the conductive layer may form the attachment to the conductive yarn. The connection may also be formed by 3d printing a conductive material.

Advantages of embodiments in which the conductive yarn is attached to the conductive layer are as follows. The contact area in which the conductive yarn and the conductive layer are attached can be made large. This ensures that the physical connection is strong and also ensures that the electrical connection between the conductive yarn and the conductive layer is over a large area which minimises the risk of disconnection. Further, multiple conductive yarns can be connected to the conductive layer.

The contact pad may be in the form of a rivet having a tail portion which is deformed to hold the contact pad in place once the tail portion has pierced the fabric substrate and the conductive fabric.

FIGS. 6A to 6F illustrate a method of manufacturing a component of a garment or textile product according to an embodiment of the present invention.

Figure 6A:
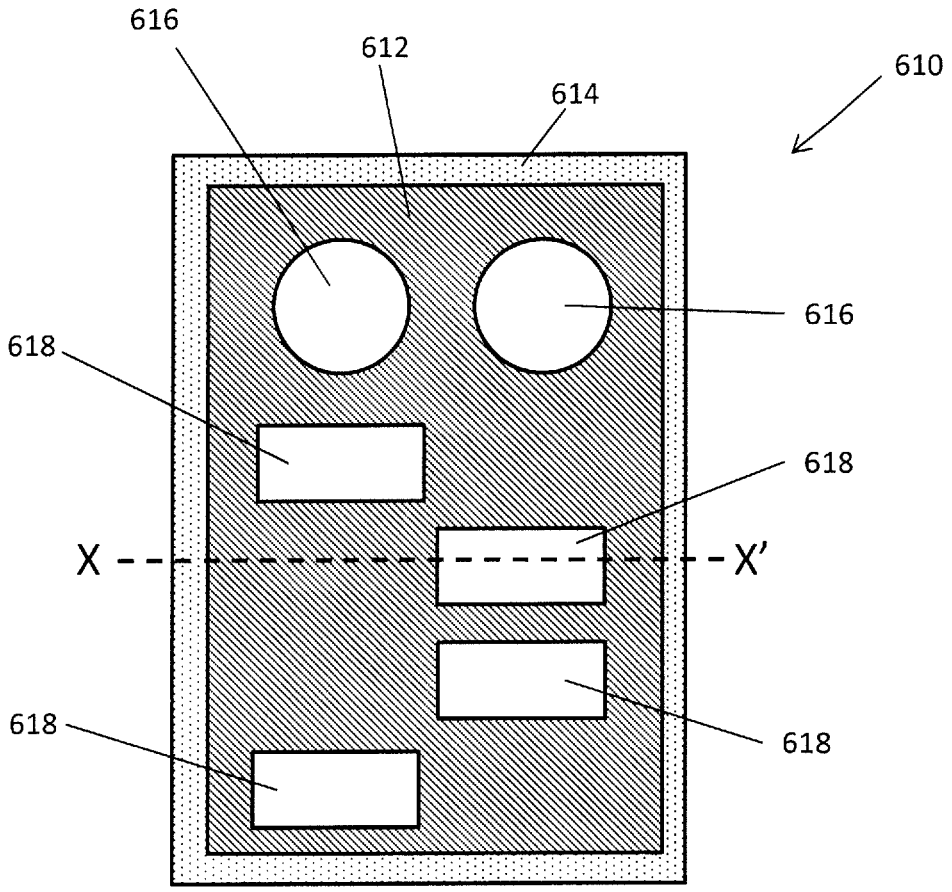
FIGS. 6A to 6F illustrate a method of manufacturing a component of a garment or textile product according to an embodiment of the present invention.
Figure 6A:
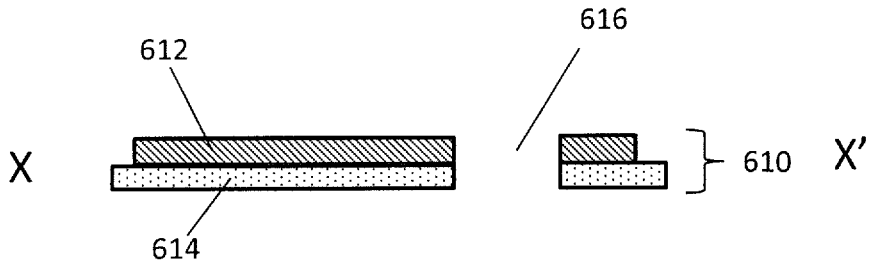

As shown in FIG. 6A, a first stack 610 is formed from a fabric layer 612 over a thermoplastic polyurethane (TPU) layer 614. As shown in FIG. 6A, the fabric layer 612 and the TPU layer 614 are rectangular. The TPU layer 614 is larger than the fabric layer 612 and a small portion of the TPU layer 614 extends beyond the edge of the fabric layer 612 on all sides. There are two circular holes 616 which extend through both the fabric layer 612 and the TPU layer 614. There are also four rectangular holes 618 which extend through the fabric layer 612 and the TPU layer 614. The holes are aligned in two columns so that there are two rectangular holes 618 aligned with each of the circular holes 616. The lower part of FIG. 6A shows a cross section along the line X-X'. As shown in the cross section, the hole 616 extends through both the fabric layer 612 and the TPU layer 614 which form the stack 610. The fabric layer 612 may be formed from any fabric as discussed above. The TPU layer may be formed from an adhesive tape such as Bemis 3415.

Figure 6B:
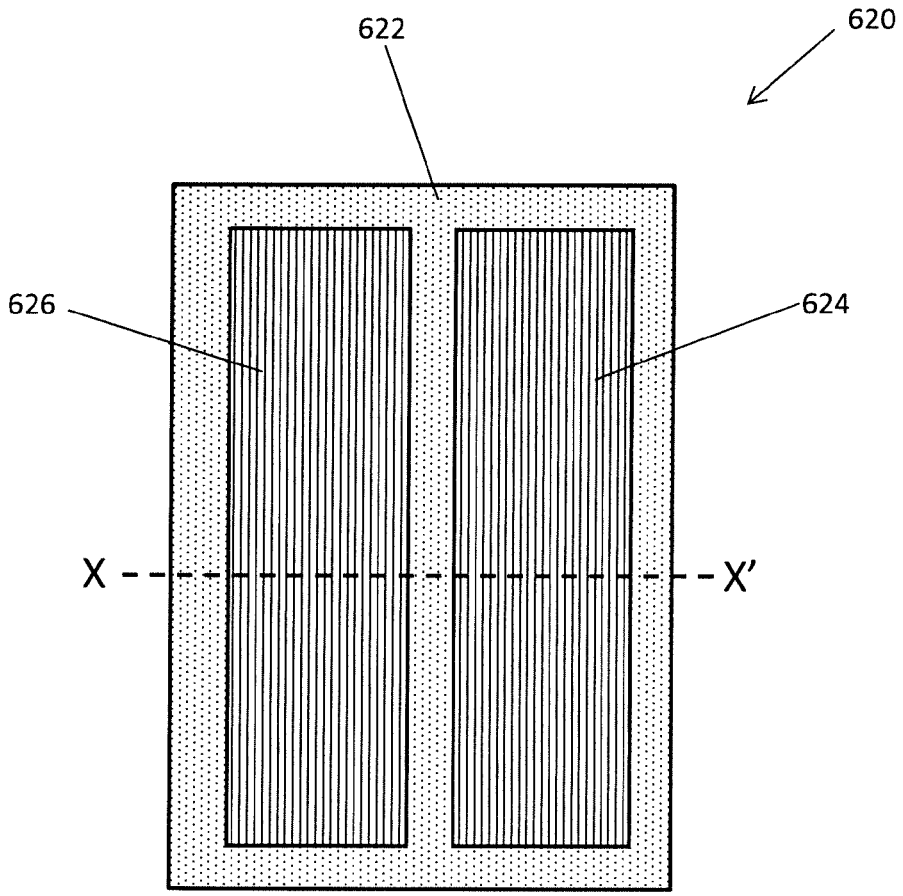
Figure 6B:
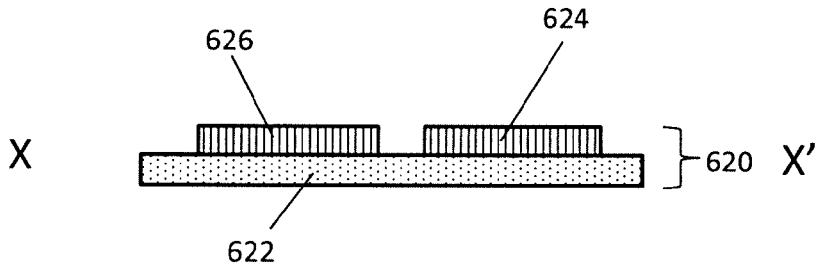

As shown in FIG. 6B, a second stack 620 is formed from a TPU layer 622 and a first conductive layer section 624 and a second conductive layer section 626. The TPU layer 622 is rectangular and has approximately the same dimensions as the TPU layer 614 of the first stack shown in FIG. 6A. The first conductive layer section 624 and the second conductive layer section 626 are separated from each other so there is no electrical connection between them. As shown in FIG. 6B, the first conductive layer section 624 and the second conductive layer section 626 form two strips running alongside each other in the direction of the largest axis of the rectangular TPU layer 622.

The lower part of FIG. 6B shows a cross section of the second stack 620. As shown in the cross section, the first conductive layer section 624 and the second conductive layer section 626 are arranged on the TPU layer 622. A gap separates the first conductive layer section 624 from the second conductive layer section 626.

Figure 6C:
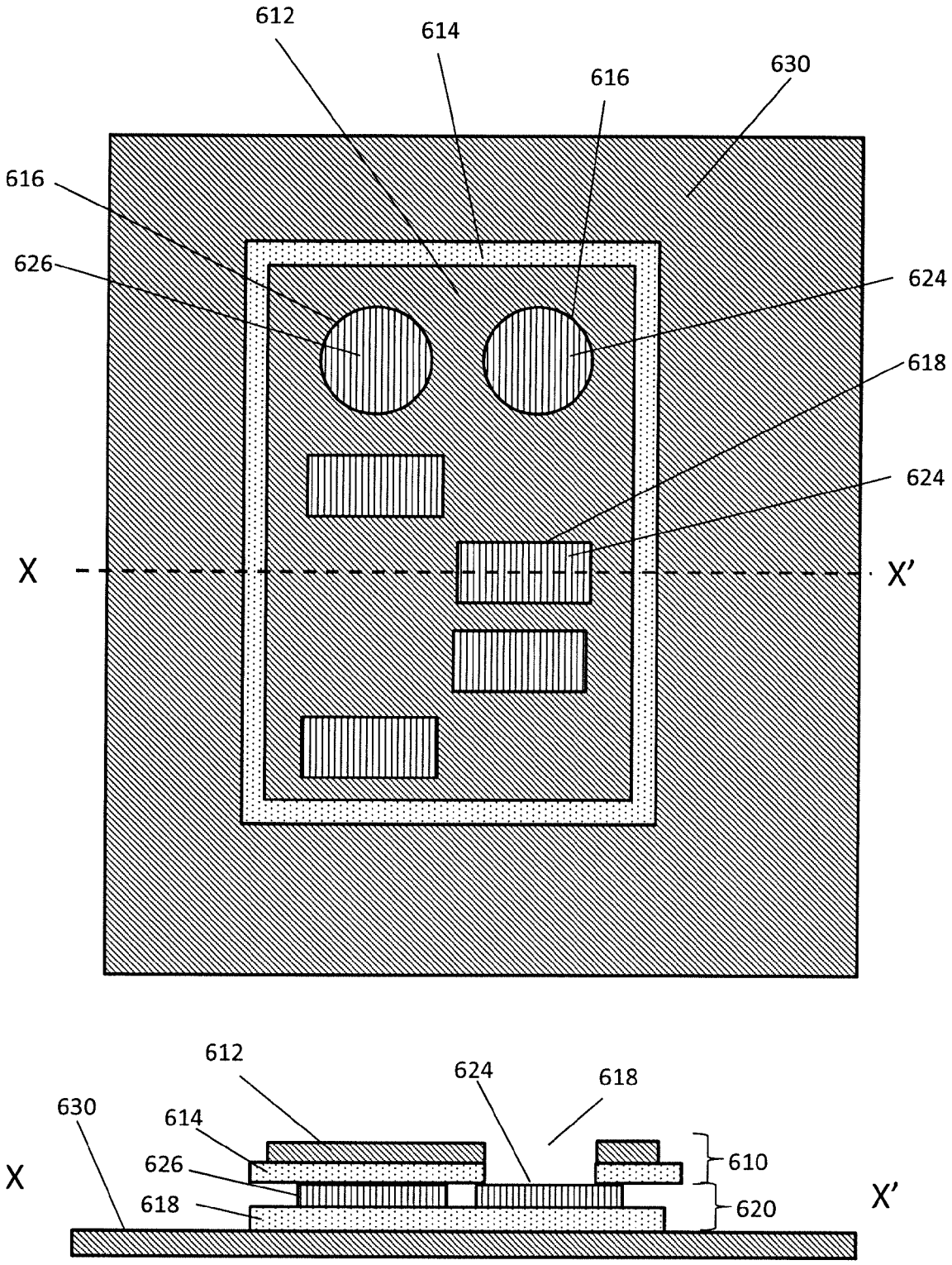

As shown in FIG. 6C, the first stack 610 is laid on top of the second stack 620 and the combined stack is laid on a fabric substrate 630. As shown in FIG. 6C, the first conductive layer section 624 is visible through the circular hole 616 and the rectangular holes 618 on the right hand side and the second conductive layer section 626 is visible through the circular hole 616 and the rectangular holes 618 on the left hand side.

The lower part of FIG. 6C shows a cross section of the combined stack comprising the first stack 610 on top of the second stack 620 over a fabric substrate 630. As shown in the cross section, the holes 618 in the fabric layer 612 and the TPU layer 614 of the first stack 610 leave the first conductive layer section 624 exposed. In the part shown in the cross section, the second conductive layer section 626 is covered by the fabric layer 612 and the TPU layer 614 of the first stack 610. The TPU layer 622 of the second stack 620 lies over the fabric substrate 630.

Figure 6D:
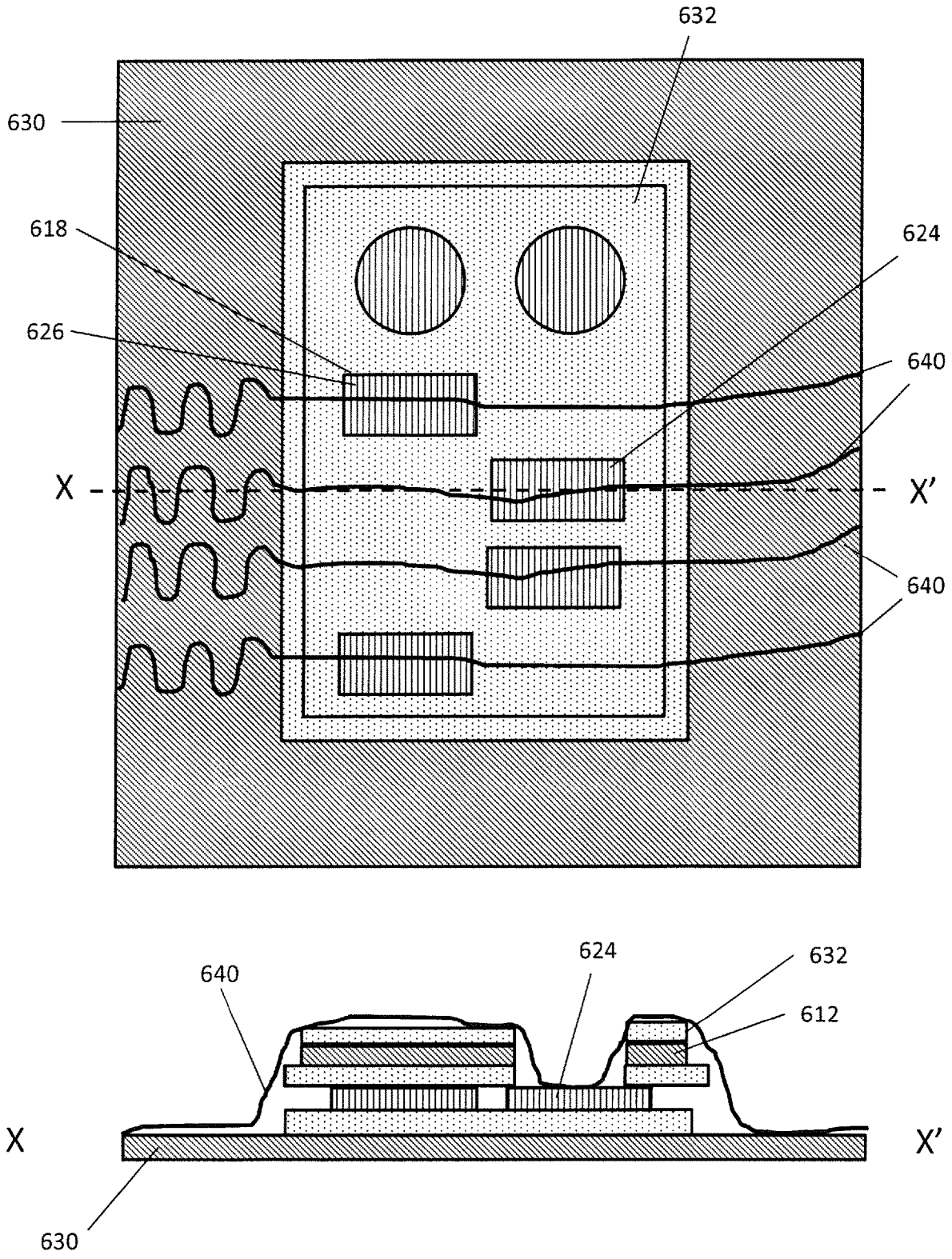

As shown in FIG. 6D, a TPU layer 632 is laid over the combined stack shown in FIG. 6C. The TPU layer has holes matching those in the first stack 610 so the first conductive layer section 624 and the second conductive layer section 626 are exposed through the circular holes and the rectangular holes.

Then, four conductive yarns 640 are laid over the TPU layer 632 in a horizontal direction as shown in FIG. 6D. Each of the conductive yarns 640 is laid over one of the rectangular holes 618. This allows the conductive yarns 640 to contact either the first conductive layer section 624 or the second conductive layer section 626.

As shown in FIG. 6D, on the left hand side, where the conductive yarns 640 are laid over the fabric substrate 630, they are laid in a sinusoidal pattern. This allows the fabric to be stretched. A layer of TPU or other layer may be laid over the conductive yarns 640 where they are laid over the fabric substrate 630.

The lower part of FIG. 6D shows a cross section along the line X-X'. As shown in the cross section, the conductive yarn 640 is attached to the second conductive layer section 626.

The conductive yarns 640 may be attached to the first conductive layer section 624 or the second conductive layer section 626 by any of the methods discussed above such as stitching, either by stitching the conductive yarn itself through the conductive layer or by stitching over a part of the conductive yarn where it overlaps with the conductive layer. Alternatively, the conductive yarn may be attached to the conductive layer with a conductive adhesive. The conductive yarn may be attached to the conductive layer sections by hot melt glue or soldering or gluing with a glue that has electrical conductivity.

Figure 6E:
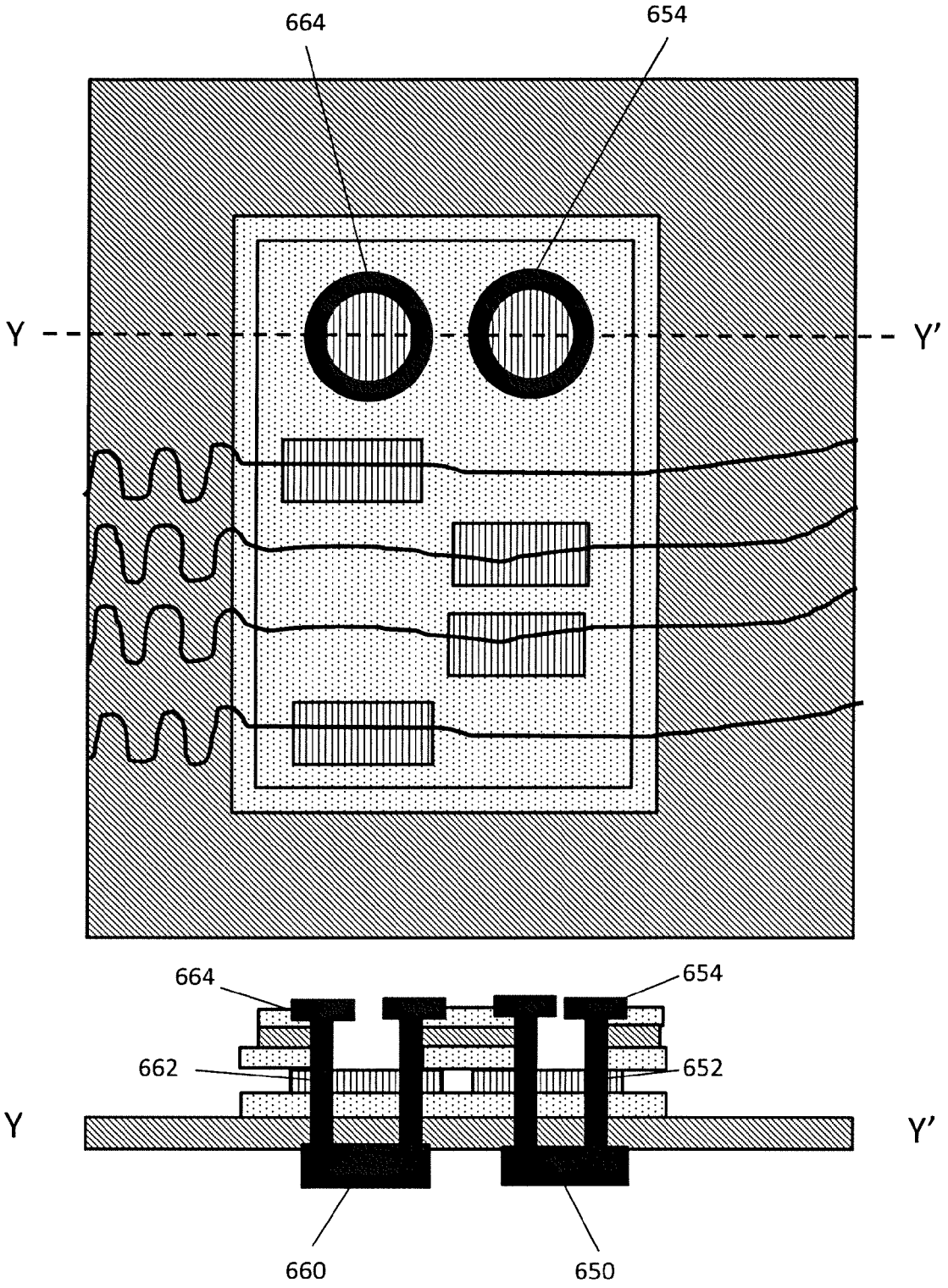

Then, two contact pads are added as shown in FIG. 6E. The lower part of FIG. 6E shows a cross section along the line Y-Y'. As shown in the cross section, a first contact pad 650 is added on the left side and a second contact pad is added on the right side. The contact pads may be as described above with reference to FIGS. 1 to 5C. As shown in the cross section of FIG. 6E, the first contact pad 650 comprises an elongate coupling portion 652 that contacts the first conductive layer section 624. Similarly, the second contact pad 660 comprises an elongate coupling portion 662 that contacts the second conductive layer section 626. The first contact pad 650 further comprises a crimped portion 654 that holds the first contact pad 650 in place. Similarly, the second contact pad 660 further comprises a crimped portion 664 that holds the second contact pad 660 in place. The first contact pad 650 and the second contact pad 660 are both formed from a conductive material such as metal.

Figure 6F:
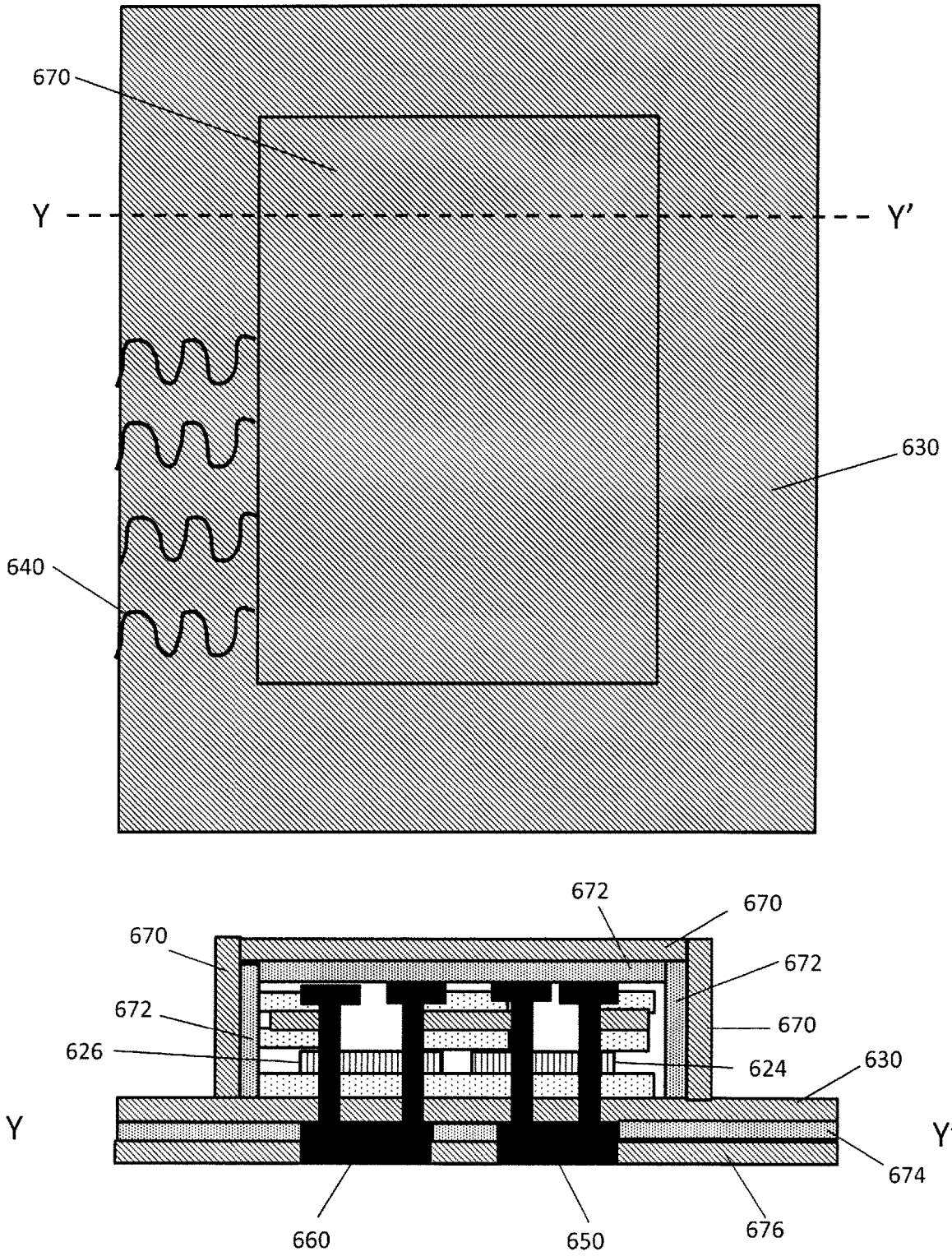

FIG. 6F shows the completed component for a garment or textile product. As shown in FIG. 6F, an encapsulating layer of fabric 670 with a waterproofing layer of TPU 672 underneath is laid over the stack shown in FIG. 6E. The ends of the conductive yarns 640 on the right hand side of the figure are also trimmed.

The lower part of FIG. 6F shows a cross section along the line Y-Y'. As shown in the cross section, the encapsulating layer of fabric 670 and waterproofing layer of TPU 672 cover the top and sides of the stack including the first conductive layer section 624 and the second conductive layer section 626. A further encapsulating layer of fabric 676 is laid over a waterproofing layer of TPU 674 on the bottom face of the fabric substrate 630.

The waterproofing layers of TPU may be formed from Bemis 3916.

As shown in the cross section of FIG. 6F, the first contact pad 650 and the second contact pad 660 extend through gaps is in the further encapsulating layer of fabric 676 is laid over a waterproofing layer of TPU 674 on the bottom face of the fabric substrate 630.

The construction shown in FIG. 6F allows electrical contact to be made with the conductive yarns 640 from the first contact pad 650 and the second contact pad 660. In the embodiment shown in FIG. 6F, the first contact pad 650 is connected to the first conductive layer 624 which is connected to a set of the conductive yarns 640. Similarly, the second contact pad 660 is connected to the first conductive layer 626 which is connected to a different set of the conductive yarns 640. Thus, a power supply may be connected across the two contact pads with one contact pad coupling to a positive supply voltage of the power supply and the other contact pad coupled to a negative or ground voltage of the power supply.

The construction shown in FIG. 6F provides a robust connection as the conductive layer sections and the connections of the conductive yarns to the conductive layer sections are encapsulated and protected by the waterproof TPU layers.

In embodiments described herein the thickness of the various layers may be as follows: the conductive fabric may have a thickness in the range 0.15 mm to 0.2 mm; the TPU layers may have a thickness in the range 0.05 to 0.15 mm; the fabric substrates may have a thickness in the range 0.2 mm to 2 mm.

The first contact pad 650 and the second contact pad 660 may be formed from metal snaps having a diameter of approximately 10 mm. The thickness of the metal snaps when attached to the fabric layer is typically in the range 0.5 mm to 1.5 mm. In some embodiments the part of the contact pad that is configured to engage with a connector may be arranged as a male or a female connector, when the contact pad is arrange as a male connector, the thickness may be approximately 0.5 mm and when the contact pad is arranged as a female connector the thickness may be approximately 1.5 mm. Here the term thickness refers to the distance between the first contact pad 650 and the crimped portion 654 and/or the distance between the second contact pad 660 and the crimped portion 664.

The coupling member formed from the elongate member extending from the contact pad may have a diameter of 2.5 mm.

Figure 7:
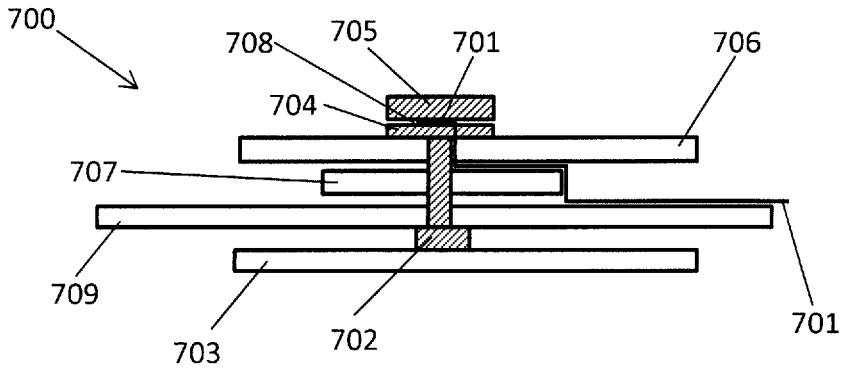
FIG. 7 shows a cross sectional view of a component for a garment or textile product according to an embodiment of the present invention.

FIG. 7 shows cross sectional view of a component for a garment or textile product according to an embodiment of the present invention. The component 700 shown in FIG. 7 comprises a wire 701 which is attached to a washer 704. The washer 704 is in conductive contact with the contact pad 705 which is configured to engage with a connector, for example, as described above in relation to FIG. 3 and FIG. 4. The wire 701 is attached to the washer 704 with lead free solder 708. The lead free solder 708 forms an electrically conductive connection between the contact pad 705 and the washer 704. The washer 704 is formed from an electrically conductive metal such as silver or aluminum and in some embodiments has a thickness of less than 0.5 mm.

The contact pad 705 is arranged on a fabric layer of a garment 709. The contact pad comprises a top substrate 706. A middle layer fabric 707 is arranged below the top substrate 706. A body portion 702 of a snap connector coupled to the contact pad 705 passes through the fabric substrate 706 and the middle layer fabric 707 and has a flanged bottom part below the middle layer fabric 707. A bottom layer fabric 703 covers the body portion 702 of the snap connector. The outer facing surfaces of the fabric substrate 706 and the bottom layer fabric 703 may be covered with waterproof TPU layers such as Bemis 3916. The bottom fabric layer 703 may be attached to the middle fabric layer 707 by a TPU layer such as Bemis 3415. Similarly, the fabric substrate 706 may be attached to the middle fabric layer 707 by a TPU layer such as Bemis 3415.

As shown in FIG. 7, the wire 701 runs through a hole in the center of the washer 704, and follows the body portion of the snap connector through the top substrate 706. Then the wire 701 runs over the middle layer fabric 707 between the top substrate 706 and the middle layer fabric 707. From the edge of the middle layer fabric 707 the wire 701 runs over the fabric layer of the garment 709. It should be noted that the layers shown in FIG. 7 would be in contact with one another, the gaps between the various layers are shown in FIG. 7 for clarity only.

As described above, the component may be encapsulated by waterproof TPU layers and thus provides a sealed and robust connection to a wire from the contact pad.

The embodiment shown in FIG. 7 may form part of a garment with an integrated heating element. Heating elements generally require large currents and therefore it is important that the resistance of the connectors is minimized. Otherwise resistive heating of the connector could result. The arrangement shown in FIG. 7 allows a large contact area between the contact pad 705, the washer 704 and the wire 701 to be realized. This large contact area minimizes the resistance of the connection and therefore minimizes the potential for resistive heating in the connection. Further, the large contact area allows a secure and robust connection with the wire 701 to be realized.

In embodiments described herein the thickness of the various layers may be as follows: the washer may have a thickness in the range 0.2 mm to 0.5 mm; the TPU layers may have a thickness in the range 0.05 to 0.15 mm; the fabric substrates may have a thickness in the range 0.2 mm to 2 mm.

The fabric substrate described herein may form part of a garment or other object made from such materials (e.g. a bag). When the fabric substrate forms part of garment, the garment may be any wearable object, such as shorts, socks, T-shirts, trousers, leggings, shirts and caps.

Various modifications to the embodiments described above are envisaged. For example, in the embodiments described above, the contact pad and the coupling portion are formed from an integral part; however, alternative embodiments are envisaged in which the connection between the contact pad and the coupling portion is formed during manufacture of the component. For example, a hole may be made through the fabric substrate and the contact pad may be attached over the hole with a conductive adhesive forming the coupling portion and making an electrical connection between the contact pad and the conductive fabric.

The invention claimed is:

1. A component for a garment or textile product, the component comprising:

a fabric substrate having a first surface and a second surface opposing the first surface;

a contact pad formed from an electrically conductive material, the contact pad being configured to engage with a connector and arranged on the first surface of the fabric substrate;

a conductive layer electrically coupled to the contact pad;

an electrically conductive line mechanically coupled to and in conductive contact with the conductive layer; and an encapsulating layer over the conductive line and the conductive layer.

2. A component for a garment or textile product according to claim 1, wherein the conductive layer comprises a metal washer.

3. A component for a garment or textile product according to claim 2, wherein the metal washer has a thickness of less than 0.5 mm.

4. A garment comprising a component according to claim 1, the garment comprising a heating element, wherein the electrically conductive line is configured to supply electrical power to the heating element.

5. A component for a garment or textile product according to claim 1, wherein the conductive layer is coupled to the second surface of the fabric substrate, and has a thickness of less than 0.2 millimetres, the component further comprising a coupling member electrically coupling the contact pad with the conductive layer, wherein the electrically conductive line comprises a conductive yarn, the conductive yarn having a thickness of less than 0.3 millimetres.

6. A component for a garment or textile product according to claim 1, further comprising a second conductive yarn mechanically coupled to, and in electrically conductive contact with, the conductive layer.

7. A component for a garment or textile product according to claim 5, wherein the conductive yarn has a thickness of less than 0.15 millimetres.

8. A component for a garment or textile product according to claim 7, wherein the conductive layer comprises a first conductive layer section and a second conductive layer section, the first conductive layer section being electrically separated from the second conductive layer section, wherein a first conductive yarn is electrically coupled to the first conductive layer section and a second conductive yarn is coupled to the second conductive layer section.

9. A component for a garment or textile product according to claim 1 wherein the contact pad is configured to engage with the connector magnetically and/or mechanically.

10. A method of manufacturing a component for a garment or textile product, the method comprising:

providing a fabric substrate having a first surface and a second surface opposing the first surface;

providing a conductive layer coupled to the first surface of the fabric substrate, the conductive layer having a thickness of less than 0.5 millimetres;

piercing an elongate member coupled to a contact pad through the fabric substrate and the conductive layer such that the contact pad is arranged on the first surface of the fabric substrate, the contact pad being configured to engage with a connector;

attaching a conductive line to the conductive layer; and laying an encapsulating layer over the conductive line and the conductive layer.

11. A method according to claim 10, wherein conductive line passes though the fabric substrate.

12. A method of manufacturing a component for a garment or textile product, the method comprising providing a fabric substrate having a first surface and a second surface opposing the first surface;

providing a conductive layer coupled to the second surface of the fabric substrate;

arranging a contact pad on the first surface of the fabric substrate, the contact pad being configured to engage with a connector and formed from an electrically conductive material;

establishing an electrical contact between the conductive layer and the contact pad;

attaching a conductive yarn in conductive contact with the conductive layer; and laying an encapsulating layer over the conductive line and the conductive layer.

13. A method according to claim 12 wherein attaching a conductive yarn in conductive contact with the conductive layer comprises attaching the conductive yarn stitching and/or a conductive adhesive.

14. A method according to claim 12, wherein the electrical contact between the conductive layer and the contact pad is provided by an elongate member having a width greater than a thickness of the conductive yarn.

15. A method of manufacturing a component for a garment or textile product, the method comprising:

providing a fabric substrate having a first surface and a second surface opposing the first surface;

providing a conductive layer coupled to the second surface of the fabric substrate, the conductive layer having a thickness of less than 0.2 millimetres;

piercing an elongate member coupled to a contact pad through the fabric substrate and the conductive layer such that the contact pad is arranged on the first surface of the fabric substrate and the elongate member establishes an electrically conductive connection between the contact pad and the conductive layer, the contact pad being configured to engage with a connector;

attaching a conductive yarn to the conductive layer, the conductive yarn having a thickness of less than 0.3 millimetres; and laying an encapsulating layer over the conductive yarn and the conductive layer.

16. A method according to claim 15, further comprising crimping an end of the elongate member.

17. A method according to claim 15, wherein the contact pad and the elongate member are formed from a rivet.

* * * * *